US007518482B2

(12) United States Patent
Fleege

(10) Patent No.: US 7,518,482 B2
(45) Date of Patent: Apr. 14, 2009

(54) TRIP UNIT HAVING A PLURALITY OF STACKED BIMETAL ELEMENTS

(76) Inventor: Dennis William Fleege, 1002 Quarry Ave. SW., Cedar Rapids, IA (US) 52404

( * ) Notice: Subject to any disclaimer, the term of this patent is extended or adjusted under 35 U.S.C. 154(b) by 241 days.

(21) Appl. No.: 11/545,432

(22) Filed: Oct. 10, 2006

(65) Prior Publication Data

US 2008/0084266 A1 Apr. 10, 2008

(51) Int. Cl.
*H01H 71/50* (2006.01)
*H01H 77/04* (2006.01)

(52) U.S. Cl. ..... 337/59; 337/36; 337/37; 337/72; 337/75

(58) Field of Classification Search ..... 337/72, 337/36, 37, 75, 59
See application file for complete search history.

(56) References Cited

U.S. PATENT DOCUMENTS 2,439,511 A * 4/1948 Green ..... 335/36
2,618,716 A 11/1952 Boller et al.
3,081,386 A * 3/1963 Pastene et al. ..... 335/9
3,179,767 A * 4/1965 Middendorf ..... 335/36
3,317,867 A 5/1967 Powell
3,745,414 A 7/1973 Frantti et al.
3,760,308 A 9/1973 Misencik et al.
4,080,582 A 3/1978 Link
4,114,122 A * 9/1978 Grenier ..... 335/8
4,232,282 A 11/1980 Menocal
4,503,408 A * 3/1985 Mrenna et al. ..... 335/35
4,513,268 A 4/1985 Seymour et al.
4,546,337 A * 10/1985 Petrie et al. ..... 335/16
4,604,596 A * 8/1986 Yokoyama et al. ..... 335/14
4,616,200 A 10/1986 Fixemer et al.
4,630,019 A * 12/1986 Maier et al. ..... 337/70
4,713,640 A 12/1987 Murphy et al.
4,897,625 A 1/1990 Yokoyama et al.
5,151,671 A 9/1992 Hirao et al.
5,173,674 A 12/1992 Pannenborg et al.
5,182,532 A 1/1993 Klein
5,225,800 A * 7/1993 Pannenborg et al. ..... 335/35
5,245,302 A * 9/1993 Brune et al. ..... 335/35
5,250,918 A * 10/1993 Edds et al. ..... 335/35
5,302,787 A 4/1994 Edds et al.
5,373,272 A 12/1994 Scheel et al.
5,381,120 A 1/1995 Arnold et al.
5,510,759 A 4/1996 Gula et al.
5,694,101 A 12/1997 Lavelle et al.
5,821,839 A 10/1998 Heise et al.
5,825,598 A 10/1998 Dickens et al.

(Continued)

*Primary Examiner*—Anatoly Vortman

(57) ABSTRACT

A trip unit in a miniature circuit breaker having a plurality of stacked bimetal elements welded front-to-back at one end and attached to a load terminal. The bimetal elements are made of similar compositions and have the same thickness. The free ends are connected to a yoke and to a pigtail that is optionally wound around the yoke in which the bimetals are received. The pigtail is connected to the conductive blade of the trip unit. To attach the pigtail from one direction, a notch is formed in the free end of one of the bimetals, exposing part of the other bimetal behind it. Or, two notches are formed in a staggered relationship such that the pigtail connections can be made from either direction. The stacked relationship of the bimetal elements allows the overall width of the circuit breaker to be reduced without sacrificing its rating requirements with one bimetal.

20 Claims, 3 Drawing Sheets

U.S. PATENT DOCUMENTS 5,831,509 A * 11/1998 Elms et al. ..... 337/333
5,864,266 A 1/1999 Mickelson et al.
5,870,008 A 2/1999 Pannenborg et al.
5,894,259 A * 4/1999 Kolberg et al. ..... 337/333
6,135,633 A * 10/2000 DiMarco et al. ..... 374/1
6,181,226 B1 * 1/2001 Leone et al. ..... 335/35
6,232,860 B1 5/2001 Acevedo et al.
6,239,676 B1 5/2001 Maloney et al.
6,313,641 B1 11/2001 Brooks
6,313,642 B1 11/2001 Brooks
6,477,022 B1 * 11/2002 Ennis et al. ..... 361/42
6,489,867 B1 12/2002 Turner et al.
6,591,482 B1 7/2003 Fleege et al.
6,801,110 B2 10/2004 Kolberg et al.
6,816,055 B2 * 11/2004 Weber ..... 337/82
6,888,431 B2 5/2005 Jordan
7,135,953 B2 * 11/2006 Leitl et al. ..... 337/84
2004/0196123 A1 10/2004 Simms et al.
2006/0028307 A1 2/2006 McCoy et al.

* cited by examiner

TRIP UNIT HAVING A PLURALITY OF STACKED BIMETAL ELEMENTS

FIELD OF THE INVENTION

This invention is directed generally to a trip unit, and, more particularly, to a trip unit having stacked bimetal elements.

BACKGROUND OF THE INVENTION

Circuit breakers provide automatic current interruption to a monitored circuit when undersired overcurrent conditions occur. These overcurrent conditions include, for example, arc faults, overloads, ground faults, and short-circuits. In a thermal magnetic circuit breaker, an overcurrent is detected when the fault current generates sufficient heat in a strip composed of a resistive element or bimetal to cause it to deflect. The mechanical deflection triggers a trip assembly that includes a spring-biased latch mechanism to force a movable contact attached to a movable conductive blade away from a stationary contact, thereby breaking the circuit. When the circuit is exposed to a current above that level for a predetermined period of time, the trip assembly activates and tripping occurs thereby opening the circuit.

The bimetal deflects in a predictable and repeatable manner across a thermal profile over a period of time, and the rate and extent of deflection is a function of various parameters, including the cross-sectional area (width, thickness), length, and composition of the bimetal element. The bimetal is attached to a yoke that is magnetically coupled to a movable armature. The movement of the bimetal in response to excessive electrical current causes the armature to move relative to the yoke, triggering a chain of mechanical actions that cause the breaker to thermally trip. For magnetic tripping in response to sudden overloads, a magnetic field induced relative to the magnetic yoke causes the armature to be moved relative to the yoke, triggering a magnetic trip.

In miniature circuit breakers, such as the QO® and Homeline® family of circuit breakers available from Square D Company, the width of the bimetal (typically ¼ inch) is limited by the width of the housing (typically ¾ to 1 inch). To decrease the width of the overall miniature circuit breaker, such as in half-size or tandem circuit breakers, the width of the bimetal would have to be decreased as well, but at the expense of the trip ratings for the circuit breaker. Alternately, the thickness of the bimetal would have to be increased in order to maintain the same cross-sectional area, but increasing thickness substantially reduces bimetal flexibility and renders thermal tripping and calibration very difficult if not impossible. Bimetals must maintain a minimum cross-sectional area for a desired $I^2t$ (current squared time) capacity in order to be flexible enough to move a given distance when heated. It is desirable to decrease the width of a miniature circuit breaker without encountering these difficulties.

Thus, a need exists for an improved apparatus and method. The present invention is directed to satisfying one or more of these needs and solving other problems.

SUMMARY OF THE INVENTION

In an embodiment of the present invention, a trip unit for circuit breakers includes a first bimetal, a second bimetal, a load terminal, a pigtail conductor, and a yoke. The first and second bimetals have a load end and a free end, and the second bimetal is attached front-to-back to the first bimetal at the load end. The load terminal is attached to an exposed surface of the first bimetal at its load end. The pigtail conductor, which is electrically connected to a conductive blade of the trip unit, is attached to exposed surfaces of the first and second bimetals at the respective free ends thereof. The yoke at least partially receives the first and second bimetals and is attached to the free end of the first bimetal or the second bimetal.

According to an aspect, the cross-sectional areas of the first and second bimetals are substantially identical, and the first and second bimetals have the same composition. The second bimetal includes a notch formed at its free end exposing part of a surface of said first bimetal. The pigtail conductor includes tail ends, a first of which is attached to the exposed end of the first bimetal and a second tail end is attached to the exposed surface of the second bimetal. The yoke is attached at the free end of the first bimetal.

According to another aspect, the yoke is attached to the free end of the first bimetal, and the pigtail conductor includes tail ends attached to respective ones of the first and second bimetals. In yet another aspect, the free end of the second bimetal includes a notch exposing part of a surface of the first bimetal opposing the second bimetal. One of the tail ends of the pigtail conductor is attached to the exposed part surface of the first bimetal, and another of the tail ends is attached to the second bimetal.

In still another aspect, the free end of the first bimetal includes a notch exposing part of a surface of the second bimetal opposing the first bimetal. In yet another aspect, the load terminal is attached to the exposed surface of the first bimetal at the load end by welding, and the first bimetal is attached to the second bimetal by welding.

Exemplary dimensions of the overall width of the trip unit are no more than three-quarters of one inch or no more than three-eighths of one inch. The high expansion surface of the second bimetal may face opposite the surface of the load terminal. The first and second bimetals may have the same composition or the same cross-sectional areas.

In another aspect, the first and second bimetals cause the trip unit to trip under substantially the same overload conditions as a trip unit having a single bimetal with twice the width of the first bimetal and the same thickness.

According to another embodiment of the present invention, a trip unit for a miniature circuit breaker having an overall width less than one inch, includes at least two bimetals, a load terminal, a yoke, a pigtail conductor, and a conductive blade. The bimetals are attached in a stacked, front-to-back relationship at load ends thereof, and each bimetal has substantially the same dimensions and are made of the same composition. The bimetals are at least partially positioned in the yoke, which is attached to one of the bimetals. The load terminal is welded to one of the at least two bimetals at its load end. The pigtail conductor includes tail ends each welded to respective free ends of the bimetals, and the conductive blade is attached to the pigtail conductor.

In an aspect, the free end of one of bimetals includes a notch exposing part of a surface of that bimetal opposing another bimetal. The pigtail conductor is welded from one side of the bimetals, and the yoke is attached from the other side of the bimetals. The free end of another one of the bimetals includes a notch dimensioned to expose the free end of that bimetal to allow both tail ends of the pigtail conductor to be welded entirely from one side of said at least two bimetals or the other side.

In another aspect, the tail ends of the pigtail conductor are welded to opposite surfaces of respective free ends of the bimetals. The pigtail conductor is optionally wound multiple times around a portion of the yoke.

In still another aspect, the bimetals cause the trip unit to trip under substantially the same rating conditions as a trip unit having a bimetal with twice the width of the bimetals and the same thickness. The bimetals may have a width no greater than three-eighths of one inch or one-eighth of one inch.

Additional aspects of the invention will be apparent to those of ordinary skill in the art in view of the detailed description of various embodiments, which is made with reference to the drawings, a brief description of which is provided below.

BRIEF DESCRIPTION OF THE DRAWINGS

The invention may best be understood by reference to the following description taken in conjunction with the accompanying drawings, in which.

DETAILED DESCRIPTION OF THE ILLUSTRATED EMBODIMENTS

Although the invention will be described in connection with certain preferred embodiments, it will be understood that the invention is not limited to those particular embodiments. On the contrary, the invention is intended to include all alternatives, modifications and equivalent arrangements as may be included within the spirit and scope of the invention as defined by the appended claims.

Figure 1:
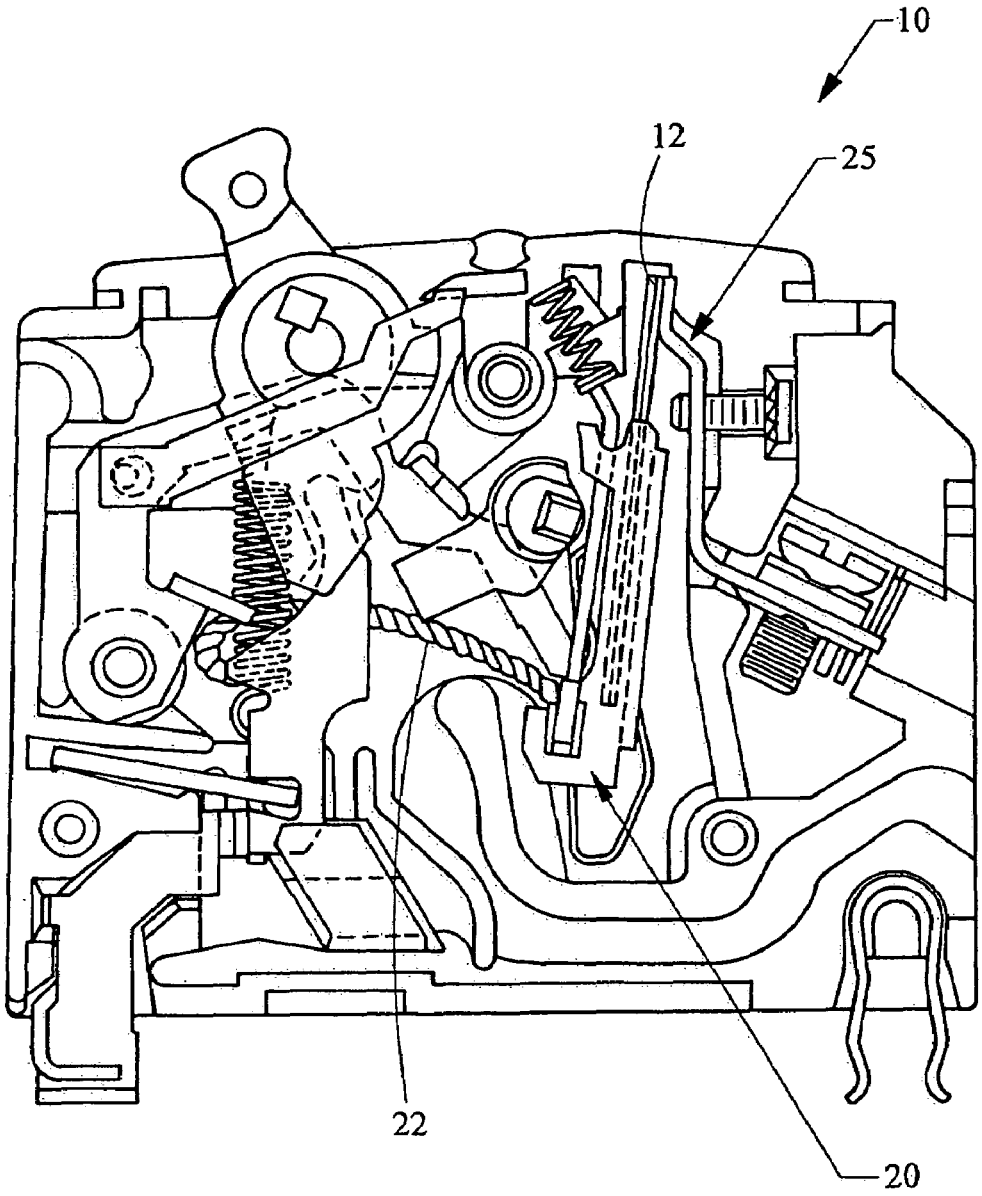
FIG. 1 is a cross-sectional diagrammatic view of certain components of a circuit breaker having stacked bimetal elements according to an aspect of the present invention.

Referring now to the drawings and initially to FIG. 1, there is shown a miniature circuit breaker 10 that includes a bimetal assembly 12 attached to a load terminal 25 at a load end of the bimetal assembly 12 and to a yoke 20 at a free end of the bimetal assembly 12 on a first side of the bimetal assembly 12. The other side of the bimetal assembly 12 at the free end is attached to a flexible pigtail conductor 22 such that both bimetals in the bimetal assembly 12 are directly heated by the attached pigtail conductor 22. These details are more clearly shown in the figures that follow. By "miniature," it is meant that the overall width of the circuit breaker is about 1 inch or smaller, preferably about ⅜ inch. According to an aspect of the present invention, the miniature circuit breaker 10 is a half-size or tandem circuit breaker in which two poles fit into the same amount of available space without sacrificing the ampere rating, protection, or features compared to a standard miniature circuit breaker. For ease of illustration, some components of a circuit breaker are omitted or not described, however, these components, which may be found in the QO® or Homeline® miniature circuit breakers available from Square D Company, are not necessary for an understanding of aspects of the present invention. The miniature circuit breaker 10 has a relatively low amperage rating, from 10 A to 150 A.

The stacked arrangement of the bimetals according to aspects of the present invention allow the width of the bimetals to be reduced while maintaining the same overall cross-sectional area, compared to a single bimetal having a larger width, commensurate with the reduction and the same thickness. Bimetal flexibility is highly dependent upon thickness. The thicker the material, the less deflection will occur for a given temperature rise. The stacked arrangement allows the bimetals to retain their original thickness while maintaining the same overall cross-sectional area and the same flexibility compared to a single bimetal and producing the same force during bending movements to overcome the latch force during tripping.

The bimetal assembly 12 includes two bimetals having the same dimensions and composition. In a conventional miniature circuit breaker, a single bimetal is used and has a width typically on the order of ¼ inch. According to a specific aspect of the present invention, the two bimetals comprising the bimetal assembly 12 have a width of ⅛ inch and are attached by a sandwich weld at the load end where the load terminal 25 is connected. The bimetals are attached in a front-to-back arrangement such that major plane surfaces of the respective bimetal elements are adjacent and aligned with one another. The other end of the bimetal assembly 12 is not attached such that each bimetal is free to bend relative to one another, avoiding undesirable binding of the two bimetals during bending movements. Because both bimetals are attached to the pigtail conductor 22, current will flow through each bimetal equally, generating uniform heat and bending in the bimetals. The combined movement and forces from the bimetals are sufficient to consistently thermally trip the circuit breaker mechanism.

In a preferred aspect, the flexible pigtail conductor 22 is attached by welding it to both bimetals to allow an equal flow of current through both bimetals simultaneously and thereby cause a uniform bending response of the bimetal assembly 12 to overcurrents. If only one bimetal were attached to the pigtail conductor 22, the other indirectly heated bimetal would react more slowly and may even act against the directly heated bimetal. This competing and unbalanced arrangement may cause inconsistent tripping or even delayed tripping, which can be dangerous and is undesired. By contrast, when both bimetals are directly heated simultaneously, they react simultaneously and uniformly (assuming identical dimensions and substantially similar compositions), resulting in consistent tripping. In this respect, the width of the bimetals can be reduced along with the width of the miniature circuit breaker without sacrificing its performance characteristics.

Though the preferred aspect described above refers to a two-bimetal assembly, in other aspects, the bimetal assembly can comprise more than two bimetals, such as three or four. For example, in an aspect, four bimetals each having a width of 1/16 inch are stacked together, yielding the same force and bending movement as the above-described two-bimetal arrangement, such that they are attached at the load end to a load terminal and the other ends are free to move relative to the others. The pigtail conductor may be attached to all four bimetals or to the two end bimetals, indirectly heating the interior bimetals. Attachment of the pigtail conductor is described in more detail in connection with FIGS. 4 and 5.

Figure 2:
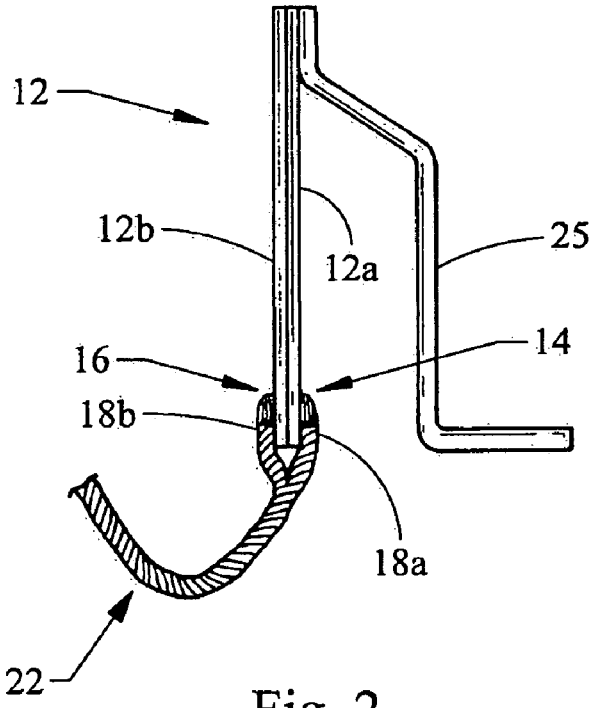
FIG. 2 is a side diagrammatic view of a bimetal assembly having a pigtail conductor attached to both bimetal elements at their respective free ends according to an aspect of the present invention.

FIG. 2 illustrates the bimetal assembly 12 comprising a first bimetal 12*a* and a second bimetal 12*b* having respective free ends 14, 16 welded to tail ends of the pigtail conductor 22. The free ends 14, 16 of the bimetal assembly 12 are free to move relative to one another, to allow the bimetals 12*a,b* to bend together without binding or buckling. The connection of the tail ends 18*a,b* of the pigtail conductor 22 to each of the bimetals 12*a,b,* respectively, causes an equal amount of electrical current to flow to each bimetal 12*a,b.* As is known, each individual bimetal is composed of two dissimilar metals that expand under thermal stress at different rates, causing the bimetal to bend in a direction away from the high-expansion side of the bimetal. As both bimetals 12*a,b* undergo thermal deflection due to excessive electrical current in the pigtail conductor 22, they undergo uniform bending movements and exert uniform forces to trip the circuit breaker mechanism in a consistent manner. Preferably, the high-expansion side of the bimetal 12*b* faces the mechanism side of the circuit breaker (i.e., the left side as shown in FIG. 2), causing the yoke to be pulled toward the armature.

The yoke is not shown in FIG. 2 for ease of illustration, and the specific attachment of the tail ends 18*a,b* of the pigtail conductor is but one of several possible attachment arrangements according to aspects of the present invention. The connection of the pigtail conductor 22 shown in FIG. 2 causes both bimetals 12*a,b* to be directly heated by electrical current passing through the pigtail conductor 22 simultaneously and equally.

Figure 3:
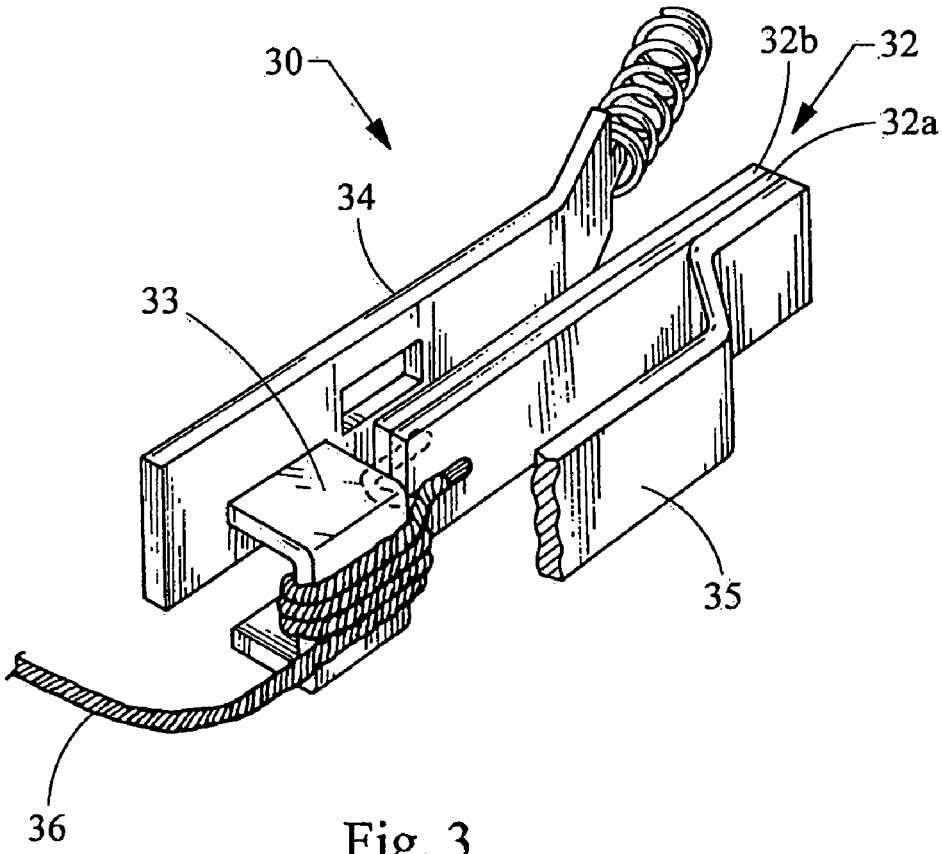
FIG. 3 is an exploded diagrammatic perspective view of a small yoke attached to stacked bimetal elements wherein each bimetal is attached to a pigtail conductor that is wound around the yoke multiple times according to an aspect of the present invention.

A smaller yoke 33 (compared to the yoke 20 shown in FIG. 1) is shown in FIG. 3 in an exploded view that includes a bimetal assembly 32 and an armature 34. A pigtail conductor 36 is wound multiple times around the yoke 33 for increasing the magnetic field required to the yoke 33 toward the armature 34. Each double turn of the pigtail conductor 36 approximately doubles the magnetic field induced by the electrical current passing through the pigtail conductor 36. A load terminal 35 is welded to a first bimetal 32*a* that is also sandwich welded to a second bimetal 32*b* at the top or load end of the bimetal assembly 32. At the opposite or free end thereof, the bimetals 32*a,b* are free to move relative to one another. Respective tail ends of the pigtail conductor 36 are welded onto the respective free ends of the bimetals 32*a,b* such that an equal amount of current passes through each bimetal 32*a, b.* Preferably, the high-expansion side of the bimetal 32*a,b* face away from the load terminal 35 and toward the trip mechanism of the circuit breaker.

Figure 4:
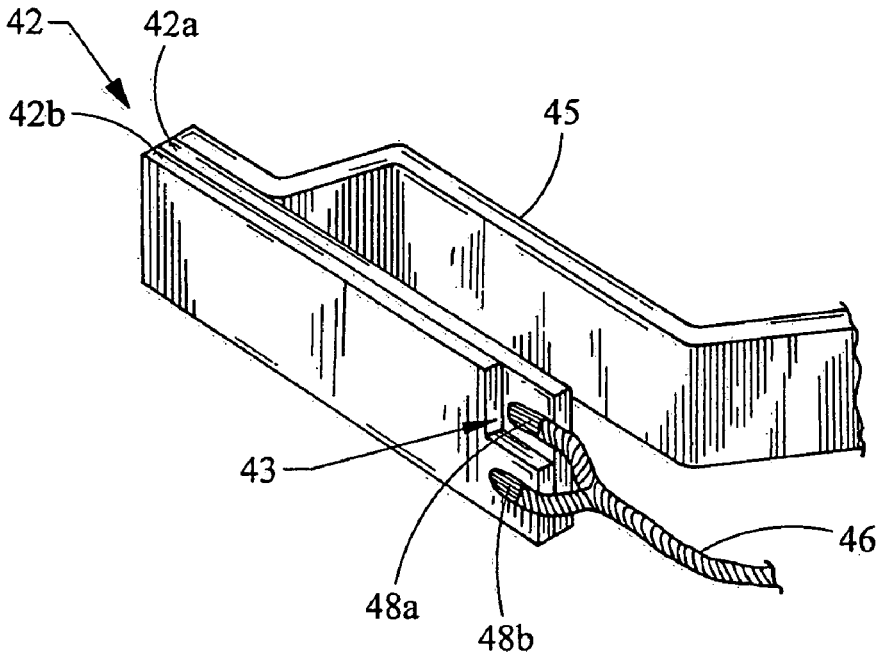
FIG. 4 is a perspective diagrammatic view of a bimetal assembly in which one bimetal has a notch for receiving a tail end of a pigtail conductor from one direction according to an aspect of the present invention.

FIG. 4 illustrates a pigtail connection according to an aspect of the present invention in a manner that directly heats both bimetals 42*a,b* of a bimetal assembly 42. The pigtail connection shown in FIG. 4 also allows a pigtail conductor 46 to be fastened to the free ends of the bimetals 42*a,b* from one direction, simplifying the assembly process. It also allows the yoke to be attached to the opposite side of the bimetal assembly 42 without having to accommodate the pigtail conductor 46, yielding a more consistent assembly process.

As shown, a notch 43 is formed in the bimetal 42*b* to allow access by the pigtail conductor 46 to both bimetals 42*a,b* from one direction. The tail ends 48*a,b* of the pigtail conductor 46 can be fastened to both free ends of the bimetals 42*a,b* from one direction. A yoke, such as the yoke 20 in FIG. 1 or the yoke 33 in FIG. 3, is welded to the other side of the bimetal 42*a.* A load terminal 45 is welded to the bimetal 42*a* at its load end.

Figure 5:
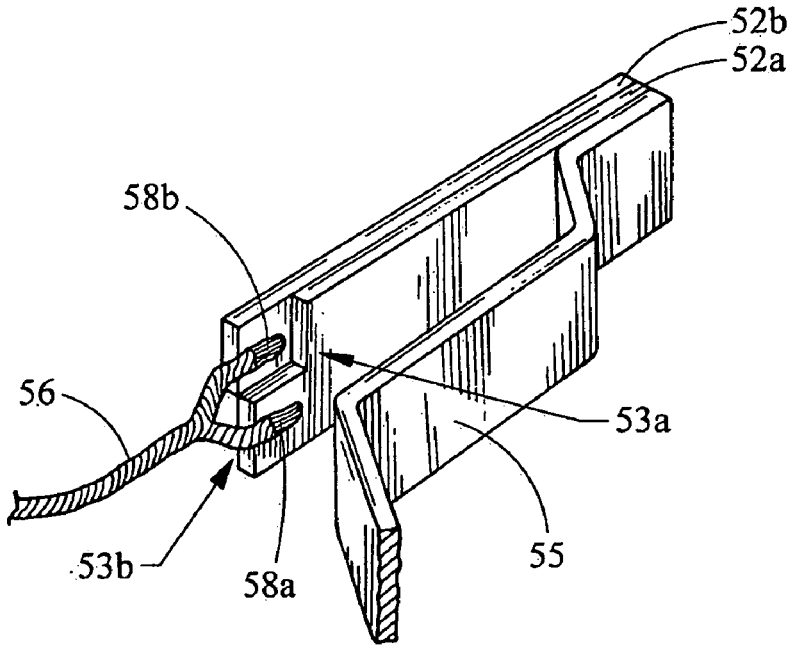
FIG. 5 is a perspective diagrammatic view of part of a bimetal assembly in which each bimetal has a staggered notch at each respective free end thereof to permit attachment of the pigtail conductor from either direction according to an aspect of the present invention.

In FIG. 5, mirror-image notches 53*a,b* are formed on respective bimetals 52*a,b* as shown so that both bimetals 52*a,b* have the same cross-sectional profile at their free ends. These notches 53*a,b* also permit the tail ends 58*a,b* of the pigtail conductor 56 to be welded from either direction. On the side where the pigtail conductor 56 is not fastened, a yoke, such as the yoke 20 in FIG. 1 or the yoke 33 shown in FIG. 3, is welded at the free end of the bimetal 52*b.* A load terminal 55 is welded to the bimetal 52*a* at its load end.

In an embodiment in which four bimetals are used, such as described above, the notches may be staggered like those in FIG. 5 to permit the pigtail conductor tail ends to be fastened therein for each bimetal.

Words of degree such as "substantially" or "about" are used herein in the sense of "at, or nearly at, given the process, control, and material limitations inherent in the stated circumstances" and are used herein to keep the unscrupulous infringer from taking advantage of unqualified or absolute values stated for exemplary embodiments.

While particular embodiments and applications of the present invention have been illustrated and described, it is to be understood that the invention is not limited to the precise construction and compositions disclosed herein and that various modifications, changes, and variations may be apparent from the foregoing descriptions without departing from the spirit and scope of the invention as defined in the appended claims.

What is claimed is:

1. A trip unit for a circuit breaker, comprising:

a first bimetal having a load end and a free end;

a second bimetal having a free end and attached front-to-back to said first bimetal at said load end;

a load terminal attached to an exposed surface of said first bimetal at the load end thereof;

a pigtail conductor, for electrical connection to a conductive blade of said trip unit, attached to exposed surfaces of said first and second bimetals at the respective free ends thereof; and a yoke at least partially receiving said first and second bimetals, said yoke being attached to the free end of said first bimetal or said second bimetal.

2. The trip unit of claim 1, wherein the cross-sectional areas of said first and second bimetals are substantially identical, said first and second bimetals having the same composition, said second bimetal having a notch formed at its free end exposing part of a surface of said first bimetal, said pigtail conductor including tail ends, a first tail end attached to said exposed end of said first bimetal and a second tail end attached to the exposed surface of said second bimetal, said yoke being attached at the free end of said first bimetal.

3. The trip unit of claim 1, wherein said yoke is attached to the free end of said first bimetal and said pigtail conductor includes tail ends attached to respective ones of said first and second bimetals.

4. The trip unit of claim 3, wherein the free end of said second bimetal includes a notch exposing part of a surface of said first bimetal opposing said second bimetal, one of the tail ends of said pigtail conductor being attached to said exposed part surface of said first bimetal, another of the tail ends being attached to said second bimetal.

5. The trip unit of claim 4, wherein the free end of said first bimetal includes a notch exposing part of a surface of said second bimetal opposing said first bimetal.

6. The trip unit of claim 1, wherein the load terminal is attached to said exposed surface of said first bimetal at the load end by welding and said first bimetal is attached to said second bimetal by welding.

7. The trip unit of claim 1 having an overall width no more than three-quarters of one inch.

8. The trip unit of claim 1 having an overall width no more than three-eighths of one inch.

9. The trip unit of claim 1, wherein the high expansion surface of said second bimetal faces opposite the surface of said load terminal.

10. The trip unit of claim 1, wherein said first bimetal and said second bimetal have the same composition.

11. The trip unit of claim 10, wherein said first bimetal and said second bimetal have the same cross-sectional areas.

12. The trip unit of claim 11, wherein said first bimetal and said second bimetal cause said trip unit to trip under substantially the same overload conditions as a trip unit having a single bimetal with twice the width of said first bimetal and the same thickness.

13. A trip unit for a miniature circuit breaker having an overall width less than one inch, comprising:

at least two bimetals attached in a stacked, front-to-back relationship at load ends thereof, each bimetal having substantially the same dimensions and made of the same composition;

a load terminal welded to one of the at least two bimetals at its load end;

a yoke in which said at least two bimetals are at least partially positioned, said yoke being attached to one of said at least two bimetals;

a pigtail conductor having tail ends each welded to respective free ends of said at least two bimetals; and a conductive blade attached to said pigtail conductor.

14. The trip unit of claim 13, wherein the free end of one of said at least two bimetals includes a notch exposing part of a surface of said one bimetal opposing another of said at least two bimetals, said pigtail conductor being welded from one side of said at least two bimetals, said yoke being attached from said other side of said at least two bimetals.

15. The trip unit of claim 14, wherein the free end of another one of said at least two bimetals includes a notch dimensioned to expose the free end of said one of said at least two bimetals to allow both tail ends of said pigtail conductor to be welded entirely from one side of said at least two bimetals or the other side.

16. The trip unit of claim 13, wherein the tail ends of said pigtail conductor are welded to opposite surfaces of respective free ends of said at least two bimetals.

17. The trip unit of claim 13, wherein said pigtail conductor is wound multiple times around a portion of said yoke.

18. The trip unit of claim 13, wherein said at least two bimetals cause said trip unit to trip under substantially the same rating conditions as a trip unit having a bimetal with twice the width of said at least two bimetals and the same thickness.

19. The trip unit of claim 13, wherein said at least two bimetals have a width no greater than three-eighths of one inch.

20. The trip unit of claim 13, wherein said at least two bimetals have a width no greater than one-eighth of one inch.

* * * * *